US008613445B2

(12) United States Patent
Nishii et al.

(10) Patent No.: US 8,613,445 B2
(45) Date of Patent: Dec. 24, 2013

(54) DRIVE TRANSMISSION DEVICE, SHEET FEEDER, AND IMAGE FORMING APPARATUS

(71) Applicants: Toshikane Nishii, Osaka (JP); Haruyuki Honda, Osaka (JP); Mitsutaka Nakamura, Hyogo (JP); Hirofumi Horita, Osaka (JP)

(72) Inventors: Toshikane Nishii, Osaka (JP); Haruyuki Honda, Osaka (JP); Mitsutaka Nakamura, Hyogo (JP); Hirofumi Horita, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/644,794

(22) Filed: Oct. 4, 2012

(65) Prior Publication Data

US 2013/0106050 A1 May 2, 2013

(30) Foreign Application Priority Data

Nov. 1, 2011 (JP) ..... 2011-240311

(51) Int. Cl.
*B65H 39/10* (2006.01)
*B65H 29/00* (2006.01)

(52) U.S. Cl.
USPC ..... 271/291; 271/186; 271/69

(58) Field of Classification Search
USPC ..... 271/291, 186, 69; 399/364, 374, 401; 74/664, 665 R, 665 F, 665 P
See application file for complete search history.

(56) References Cited

U.S. PATENT DOCUMENTS

| | | | | |
|---|---|---|---|---|
| 7,448,293 | B2 * | 11/2008 | Li | 74/354 |
| 7,896,343 | B2 * | 3/2011 | Iwago et al. | 271/301 |
| 2008/0284090 | A1 | 11/2008 | Honda et al. | |
| 2010/0032885 | A1 * | 2/2010 | Xu | 271/8.1 |
| 2010/0139453 | A1 * | 6/2010 | Chu et al. | 74/664 |
| 2010/0192710 | A9 | 8/2010 | Hanashima et al. | |
| 2011/0058873 | A1 | 3/2011 | Honda et al. | |

FOREIGN PATENT DOCUMENTS

| | | |
|---|---|---|
| JP | 9-124207 | 5/1997 |
| JP | 2007-055706 | 3/2007 |
| JP | 2007-076881 | 3/2007 |
| JP | 2007-091401 | 4/2007 |
| JP | 2007-230657 | 9/2007 |
| JP | 2008-285279 | 11/2008 |
| JP | 2009-062100 | 3/2009 |

* cited by examiner

*Primary Examiner* — David H Bollinger
(74) *Attorney, Agent, or Firm* — Harness, Dickey & Pierce P.L.C.

(57) ABSTRACT

A drive transmission device includes a gear train and a movable gear locking device. The gear train transmits rotational drive to a drive target, and includes a first gear train forming a first transmission path for transmitting the drive to the target, a second gear train forming a second transmission path for transmitting the drive to the target as drive opposite in rotation direction to the drive transmitted by the first gear train, and a movable gear movable between a first drive transmission position whereat the movable gear forms a part of the first gear train to transmit the drive to the target and a second drive transmission position whereat the movable gear forms a part of the second gear train to transmit the drive to the target. The movable gear locking device locks the movable gear at an idle position.

11 Claims, 8 Drawing Sheets

DRIVE TRANSMISSION DEVICE, SHEET FEEDER, AND IMAGE FORMING APPARATUS

CROSS-REFERENCE TO RELATED APPLICATION

This patent application is based on and claims priority pursuant to 35 U.S.C. §119 to Japanese Patent Application No. 2011-240311, filed on Nov. 1, 2011, in the Japan Patent Office, the entire disclosure of which is hereby incorporated by reference herein.

BACKGROUND OF THE INVENTION

1. Field of the Invention

The present invention relates to a drive transmission device including a gear train which transmits rotational drive from a drive source to a drive target, and to a sheet feeder and an image forming apparatus each including the drive transmission device.

2. Description of the Related Art

There is a known sheet feeder which reverses the direction of feeding force applied to a sheet fed to a predetermined feed path in an image forming device to thereby change the direction of the sheet and switch back the sheet.

This type of sheet feeder includes a roller member capable of being driven to rotate in both the forward and reverse directions. When driven to rotate in a first rotation direction, the roller member applies to the sheet a feeding force the same in direction as the feeding force applied to feed the sheet to the predetermined feed path. When driven to rotate in a second rotation direction opposite to the first rotation direction with predetermined timing, the roller member switches back the sheet.

Further, there is a known drive transmission device (hereinafter referred to as the first known drive transmission device) capable of transmitting both rotational drive in the forward direction and rotational drive in the reverse direction to a roller member as the drive target by changing the rotation direction of a drive motor serving as the drive source.

Another known drive transmission device (hereinafter referred to as the second known drive transmission device) includes, as the gear train for transmitting the rotational drive from the drive motor to the roller member, two gear trains which transmit rotational drives in opposite directions, and each of which is provided with a clutch mechanism for switching between connection and disconnection of the drive transmission.

Still another known drive transmission device (hereinafter referred to as the third background drive transmission device) includes a gear train which transmits the rotational drive from the drive source to the roller member, and in which the extreme upstream gear in the drive transmission direction serves as a drive input gear. The third known drive transmission device further includes a first drive transmission gear train and a second drive transmission gear train. The first drive transmission gear train includes an odd number of gears, and forms a first path for transmitting the rotational drive of the drive input gear. The second drive transmission gear train includes an even number of gears, and forms, separately from the first path of the first drive transmission gear train, a second path for transmitting the rotational drive of the drive input gear. The third known drive transmission device further includes a movable gear (also referred to as a swing gear) movable between a first drive transmission position and a second drive transmission position. At the first drive transmission position, the movable gear meshes with the extreme downstream gear of the first drive transmission gear train in the drive transmission direction. At the second drive transmission position, the movable gear meshes with the extreme downstream gear of the second drive transmission gear train in the drive transmission direction. Located at the first drive transmission position or the second drive transmission position, the movable gear transmits the drive to a gear which inputs the drive to the roller member.

According to the first known drive transmission device, if the drive motor also functions as the drive source of another rotary member as well as the drive source of the roller member, the roller member is not allowed to receive the input of the rotational drive in the reverse direction or stop rotating, when the another rotary member needs to receive the input of the rotational drive in the forward direction. Consequently, the degree of freedom in controlling the rotational drive of the roller member is reduced.

The second known drive transmission device allows the rotational drive in a fixed direction input from the drive motor to be transmitted to the roller member either as the rotational drive in the forward direction or the rotational drive in the reverse direction in accordance with switching between the clutch mechanisms for connecting the drive transmission. If the drive motor also functions as the drive source of another rotary member, and if the another rotary member needs to receive the input of the rotational drive in the forward direction, therefore, the roller member is allowed to receive the input of the rotational drive in the reverse direction in accordance with switching between the clutch mechanisms for connecting the drive transmission. Further, if the two clutch mechanisms are disengaged, the rotational drive of the roller member is allowed to be stopped, even when the rotary member needs to receive the input of the rotational drive in the forward direction. According to the second known drive transmission device, therefore, the degree of freedom in controlling the rotational drive of the roller member is increased, when the drive motor also functions as the drive source of another rotary member.

A clutch mechanism, however, engages and disengages, with at least one gear moving between a position for connecting the drive and a position for disconnecting the drive. The second known drive transmission device includes two clutch mechanisms. This configuration increases the device size and complicates the device structure.

The third known drive transmission device switches the position of the movable gear between the first drive transmission position and the second drive transmission position, to thereby change the gear train which transmits the rotational drive to the movable gear. Further, the first drive transmission gear train includes an odd number of gears, and the second drive transmission gear train includes an even number of gears. Therefore, the rotation direction of the rotational drive transmitted to the movable gear is different between the first drive transmission gear train and the second drive transmission gear train. With this change of the gear train which transmits the rotational drive to the movable gear, therefore, the rotational drive in the fixed direction input from the drive motor is allowed to be transmitted to the roller member either as the rotational drive in the forward direction or the rotational drive in the reverse direction. If the drive motor also functions as the drive source of another rotary member, and if the another rotary member needs to receive the input of the rotational drive in the forward direction, therefore, the roller member is allowed to receive the input of the rotational drive in the reverse direction in accordance with switching of the position of the movable gear between the first drive transmission position and the second drive transmission position.

Further, in the third known drive transmission device, the movable gear is the only gear to be moved to change the rotation direction of the roller member. Therefore, the increase in device size and the complication of the device structure are minimized, as compared with the second known drive transmission device, which moves two gears.

In the third known drive transmission device, however, the position of the movable gear is either one of the first drive transmission position and the second drive transmission position. When the drive motor is driven, therefore, either one of the rotational drive in the forward direction and the rotational drive in the reverse direction is input to the roller member. Accordingly, when the rotational drive in the forward direction needs to be input to another rotary member, which shares the drive source with the roller member, the rotational drive of the roller member is not allowed to be stopped. As a result, the degree of freedom in controlling the rotational drive of the roller member is reduced.

The above-described issues are not limited to the drive transmission device which transmits the drive to the roller member as the drive target, and may arise in any device which transmits the rotational drive input from the drive source to the drive target via a gear train.

SUMMARY OF THE INVENTION

The present invention describes a novel drive transmission device. In one example, the drive transmission device includes a gear train and a movable gear locking device. The gear train transmits rotational drive input from a drive source to a drive target, and includes a first gear train, a second gear train, and a movable gear. The first gear train forms a first transmission path for transmitting the rotational drive to the drive target. The second gear train forms a second transmission path for transmitting the rotational drive to the drive target as rotational drive opposite in rotation direction to the rotational drive transmitted by the first gear train. The movable gear is movable between a first drive transmission position at which the movable gear forms a part of the first gear train and causes the first gear train to transmit the rotational drive to the drive target and a second drive transmission position at which the movable gear forms a part of the second gear train and causes the second gear train to transmit the rotational drive to the drive target. The movable gear locking device locks the movable gear at an idle position different from the first drive transmission position and the second drive transmission position.

The above-described drive transmission device may further include a movable gear supporting member that rotatably supports the movable gear and a movable gear moving mechanism that, when in an OFF state, places the movable gear at the first drive transmission position, and that, when in an ON state, moves the movable gear supporting member and thereby place the movable gear at the second drive transmission position. The movable gear locking device may include a hitting member that strikes a contact portion of the movable gear supporting member, to thereby cause the movable gear moving from the first drive transmission position toward the second drive transmission position to stop at the idle position, and a hitting member moving mechanism that, when in one of an ON state and an OFF state, places the hitting member at a hitting position at which the hitting member strikes the contact portion, and that, when in the other one of the ON state and the OFF state, places the hitting member at a retreat position at which the hitting member does not strike the contact portion. The gear train may further include a drive input gear serving as an extreme upstream gear of the gear train in a drive transmission direction, a first drive transmission gear train that forms a first path for transmitting the rotational drive of the drive input gear to the movable gear, and includes a first output gear serving as an extreme downstream gear of the first drive transmission gear train in the drive transmission direction and meshing with the movable gear at the first drive transmission position, a second drive transmission gear train that forms, separately from the first path, a second path for transmitting the rotational drive of the drive input gear to the movable gear, that includes a second output gear serving as an extreme downstream gear of the second drive transmission gear train in the drive transmission direction and meshing with the movable gear at the second drive transmission position, and that includes an even number of gears when the first drive transmission gear train includes an odd number of gears, and include an odd number of gears when the first drive transmission gear train includes an even number of gears, and a downstream gear train that transmits the rotational drive of the movable gear to the drive target. The first gear train may include the drive input gear, the first drive transmission gear train, the movable gear, and the downstream gear train. The second gear train may include the drive input gear, the second drive transmission gear train, the movable gear, and the downstream gear train.

The contact portion of the movable gear supporting member may include a surface perpendicular to the moving direction of the movable gear moving from the first drive transmission position to the second drive transmission position.

One of the contact portion of the movable gear supporting member and a portion of the hitting member striking each other may include a circular-arc projecting shape.

One of the contact portion of the movable gear supporting member and a portion of the hitting member striking each other may include a recessed wedge shape, and the other one thereof comprises a projecting wedge shape dimensioned to fit in the recessed wedge shape.

The present invention further describes a novel sheet feeder. In one example, the sheet feeder includes a sheet feed path, a reverse sheet feed roller, and the above-described drive transmission device. The sheet feed path receives a sheet. The reverse sheet feed roller contacts the sheet in the sheet feed path and rotate in a first rotation direction to feed the sheet in a first feeding direction, and contacts the sheet in the sheet feed path and rotate in a second rotation direction opposite to the first rotation direction to feed the sheet in a second feeding direction. The drive transmission device transmits rotational drive in one of the first rotation direction and the second rotation direction to the reverse sheet feed roller serving as a drive target.

The above-described sheet feeder may further include a branching member movable between a first position for guiding the sheet fed from upstream to a first feed path and a second position for guiding the sheet fed from upstream to a second feed path, the branching member located at the first position in one of the ON state and the OFF state of the hitting member moving mechanism, and located at the second position in the other one of the ON state and the OFF state of the hitting member moving mechanism.

The above-described sheet feeder may further include a first driven roller that contacts the reverse sheet feed roller to form a first feed nip, and configured to rotate in accordance with the rotation of the reverse sheet feed roller, and a second driven roller that contacts the reverse sheet feed roller to form a second feed nip, and configured to rotate in accordance with the rotation of the reverse sheet feed roller. The sheet guided to the first feed path by the branching member may reach the first feed nip and pass through the first feed nip in accordance with the rotation of the reverse sheet feed roller. The sheet guided to the second feed path by the branching member may reach the second feed nip, and the rotation direction of the reverse sheet feed roller may be reversed before the rear end of the sheet passes through the second feed nip, to thereby feed the sheet in the second feeding direction opposite to the first feeding direction.

The above-described sheet feeder may further include at least one downstream reverse feed roller provided downstream of the reverse sheet feed roller in the second feeding direction. An ON and OFF control may be performed on the hitting member moving mechanism and the movable gear moving mechanism to synchronize the driving of the reverse feed roller with the driving of the downstream reverse feed roller.

In the ON and OFF control of the hitting member moving mechanism and the movable gear moving mechanism, an operation start signal may be transmitted to each of the hitting member moving mechanism and the movable gear moving mechanism faster than one of start and stop of the operation of the downstream reverse feed roller by a predetermined time taken for the each of the hitting member moving mechanism and the movable gear moving mechanism to receive the operation start signal and complete the operation thereof.

The present invention further describes a novel image forming apparatus. In one example, the image forming apparatus includes an image forming unit that forms an image on a sheet and the above-described sheet feeder configured to feed the sheet inside the image forming apparatus.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein:

FIG. 4 is an explanatory diagram of the gear train forming the sheet discharge drive transmission device of the sheet feeder, wherein the first solenoid is ON;

DETAILED DESCRIPTION OF THE INVENTION

Figure 1:
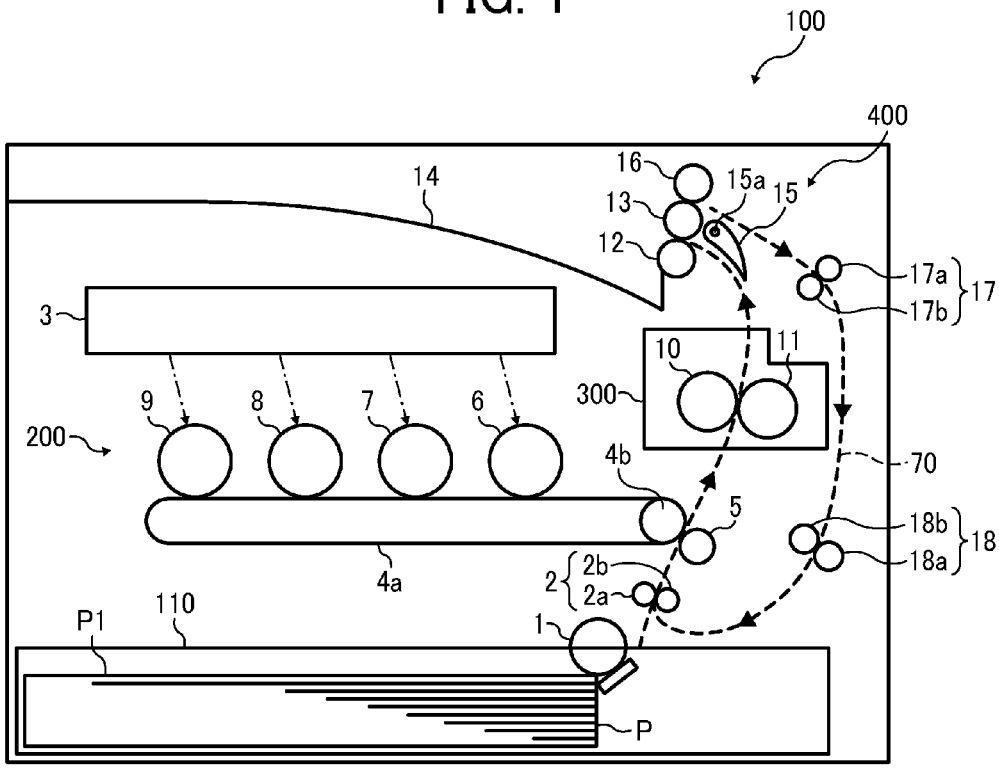
FIG. 1 is a schematic configuration diagram of a printer according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that operate in a similar manner and achieve a similar result.

Referring now to the drawings, wherein like reference numerals designate identical or corresponding parts throughout the several views, a printer according to an embodiment of the present invention (hereinafter referred to as the printer 100) will be described.

FIG. 1 is a schematic configuration diagram of the printer 100. The application of a drive transmission device according to an embodiment of the present invention is not limited to the type of image forming apparatus illustrated in FIG. 1 (i.e., the printer 100) or the type of sheet feeder illustrated in FIG. 1 (i.e., a later-described sheet feeder 400). A drive transmission device according to an embodiment of the present invention is applicable to a variety of other types of devices, in which the drive transmission device transmits rotational drive to a drive target.

The printer 100 includes a sheet feeding unit 110, an image forming unit 200, a fixing device 300, and a sheet feeder 400. The sheet feeding unit 110, which is provided below the image forming unit 200 and including a sheet feed roller 1, feeds an uppermost sheet P1 of a stacked sheet bundle P toward the image forming unit 200. The image forming unit 200 forms an image on the sheet P1. The sheet P1 is a sheet serving as a recording medium.

The image forming unit 200 includes four photoconductors 6, 7, 8, and 9 for yellow, magenta, cyan, and black colors, respectively, an exposure device 3 provided above the photoconductors 6 to 9 and serving as a latent image forming device, and an intermediate transfer belt 4*a* provided under the photoconductors 6 to 9. Each of the photoconductors 6 to 9 is surrounded by, for example, a charging device, a development device, a primary transfer device, a cleaning device, and a discharging device, which are not illustrated in FIG. 1. The image forming unit 200 further includes a secondary transfer roller 5 provided on the right side of the intermediate transfer belt 4*a* in FIG. 1, and a secondary transfer opposite roller 4*b* facing the secondary transfer roller 5 via the intermediate transfer belt 4*a*. The secondary transfer opposite roller 4*b* and the secondary transfer roller 5 form a secondary transfer nip in which a toner image on the intermediate transfer belt 4*a* is transferred to the sheet P1. Below the secondary transfer nip in FIG. 1, a registration roller pair 2 is provided which includes a registration drive roller 2*a* and a registration driven roller 2*b*.

A description will now be given of image formation performed in the printer 100. Simplex printing will be first described. When the sheet feed roller 1 of the sheet feeding unit 110 is driven to rotate, the uppermost sheet P1 of the stacked sheet bundle P is fed. Then, the leading end of the sheet P1 fed by the sheet feed roller 1 reaches a registration nip formed by the registration roller pair 2, and the sheet feed roller 1 continues to rotate. Thereby, the sheet P1 with the leading end having reached the registration nip is subjected to skew correction. Upon completion of the skew correction, the sheet feed roller 1 stops rotating.

By contrast, in the image forming unit 200, the photoconductors 6 to 9 are uniformly charged by the respective not-illustrated charging devices. Then, on the basis of image information input from an external device, such as a personal computer or a scanner, the exposure device 3 irradiates each of the uniformly charged photoconductors 6 to 9 with laser light based on the image information of the corresponding color. Thereby, electrostatic latent images are formed on the respective outer circumferential surfaces of the photoconductors 6 to 9. The electrostatic latent images formed on the photoconductors 6 to 9 are then developed by the respective not-illustrated development devices each storing a toner of the corresponding color. Thereby, toner images are formed on the outer circumferential surfaces of the photoconductors 6 to 9. Thereafter, the toner images formed on the photoconductors 6 to 9 are sequentially transferred to the intermediate transfer belt 4*a* in a superimposed manner. Thereby, a color toner image is formed on the intermediate transfer belt 4*a*.

Then, the registration roller pair 2 starts rotating to synchronize the arrival of the sheet P1 with the arrival of the toner image on the intermediate transfer belt 4*a* at the secondary transfer nip. Thereby, the toner image is transferred to the sheet P1 fed to the secondary transfer nip during the passage of the sheet P1 through the secondary transfer nip. The sheet P1 having the toner image transferred thereto then passes through a fixing nip formed by a fixing roller 10 and a pressure roller 11 included in the fixing device 300. During the passage, the toner image is thermally fixed on the sheet P1 with heat and pressure applied thereto. The sheet P1 having the toner image fixed thereon is then discharged to a discharged sheet stacking unit 14 through a sheet discharge nip (also referred to as a first feed nip) formed by a sheet discharge roller 13 (also referred to as a reverse sheet feed roller) and a sheet discharge driven roller 12 (also referred to as a first driven roller). A path including the first feed nip will also be referred to as a first feed path.

In the case of duplex printing, current is applied to a second solenoid 60 (see FIG. 3), which will be described in detail later. Thereby, a branching member 15 in the state illustrated in FIG. 1 rotates around a branching member shaft 15*a* in the clockwise direction to block the first feed path leading to the sheet discharge nip. Then, the sheet P1 fed from the fixing nip is sent by the branching member 15 to a reversing nip (also referred to as a second feed nip) formed by the sheet discharge roller 13 and a reverse driven roller 16 (also referred to as a second driven roller). A path including the second feed nip will also be referred to as a second feed path. Immediately before the rear end of the sheet P1 reaches the reversing nip, the rotation direction of the sheet discharge roller 13 is reversed to feed the sheet P1 to a duplex feed path 70, which is a reversed sheet feed path provided with a duplex entrance feed roller pair 17 and a duplex exit feed roller pair 18. The duplex entrance feed roller pair 17 includes a duplex entrance drive roller 17*a* (also referred to as a downstream reverse feed roller) and a duplex entrance driven roller 17*b*, which form a duplex entrance nip. The duplex exit feed roller pair 18 includes a duplex exit drive roller 18*a* and a duplex exit driven roller 18*b*, which form a duplex exit nip. The sheet P1 having passed the duplex feed path 70 again passes through the registration nip, the secondary transfer nip, and the fixing nip, and is guided to the first feed path leading to the sheet discharge nip by the branching member 15, which has returned to the state illustrated in FIG. 1. The sheet P1 then passes through the sheet discharge nip, and is discharged to the discharged sheet stacking unit 14. Thereby, the printing is completed. The position at which the branching member 15 guides the sheet P1 to the first feed path and the position at which the branching member 15 guides the sheet P1 to the second feed path will also be referred to as a first position and a second position, respectively.

In the printer 100, the sheet feeder 400 includes the sheet feed roller 1, the registration roller pair 2, the secondary transfer opposite roller 4*b*, the secondary transfer roller 5, the fixing roller 10, the pressure roller 11, the sheet discharge roller 13, the sheet discharge driven roller 12, the reverse driven roller 16, the duplex entrance feed roller pair 17, and the duplex exit feed roller pair 18.

Figure 2:
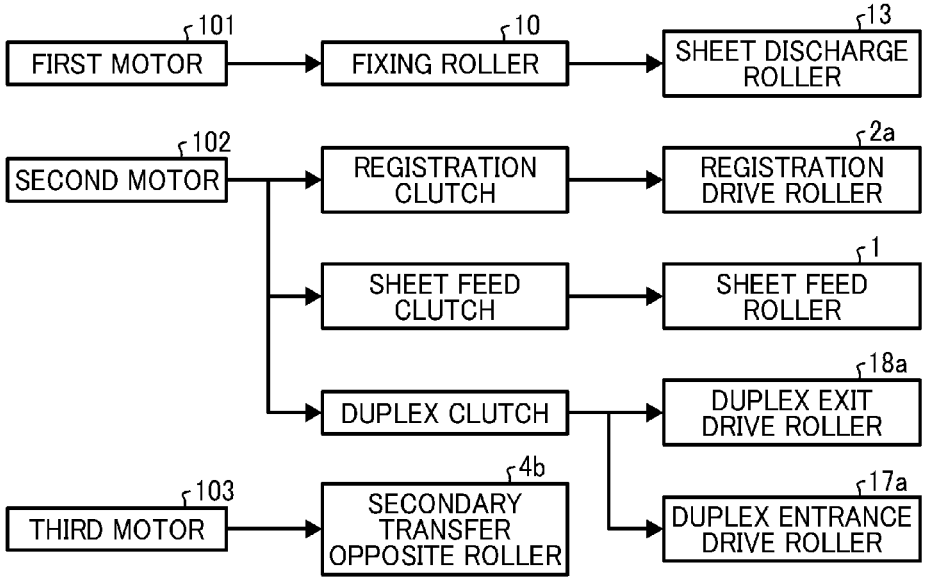
FIG. 2 is a block diagram illustrating the relationships between drive transmission paths and drive sources of drive rollers in a sheet feeder of the printer.

FIG. 2 is a block diagram illustrating the relationships between the drive transmission paths and the drive sources of the drive rollers of the sheet feeder 400 included in the printer 100. A first motor 101 serves as the drive source of the fixing roller 10 and the sheet discharge roller 13. A fixing drive gear 20 (see FIGS. 3 and 4) fixed to a not-illustrated rotary shaft of the fixing roller 10 and a sheet discharge drive gear 30 (see FIGS. 3 and 4) fixed to a not-illustrated rotary shaft of the sheet discharge roller 13 are connected by a gear train, which will be described in detail later. In accordance with the input of rotational drive to the fixing drive gear 20 (also referred to as a drive input gear) from the first motor 101, therefore, the fixing roller 10 and the sheet discharge roller 13 are driven to rotate.

A second motor 102 serves as the drive source of the registration drive roller 2*a*, the sheet feed roller 1, the duplex exit drive roller 18*a*, and the duplex entrance drive roller 17*a*. Rotational drive is transmitted from the second motor 102 to the registration drive roller 2*a* via a registration clutch, to the sheet feed roller 1 via a sheet feed clutch, and to the duplex exit drive roller 18*a* and the duplex entrance drive roller 17*a* via a duplex clutch. It is therefore possible to control the rotation timing of the respective drive rollers, i.e., the registration drive roller 2*a*, the sheet feed roller 1, the duplex exit drive roller 18*a*, and the duplex entrance drive roller 17*a*, by controlling the connection and disconnection of the registration clutch, the sheet feed clutch, and the duplex clutch, while driving the second motor 102 to rotate.

A third motor 103 serves as the drive source of the secondary transfer opposite roller 4*b*. It is possible to control the rotation timing of the secondary transfer opposite roller 4*b* by controlling the drive or stop timing of the third motor 103. The secondary transfer opposite roller 4*b* is one of a plurality of stretching rollers for stretching the intermediate transfer belt 4*a*, and serves as a belt drive roller which is rotated to rotate the intermediate transfer belt 4*a*. It is therefore possible to control the rotation timing of the intermediate transfer belt 4*a* and the rotation timing of the secondary transfer roller 5, which forms the secondary transfer nip with the secondary transfer opposite roller 4*b* via the intermediate transfer belt 4*a*, by controlling the drive or stop timing of the third motor 103.

Figure 3:
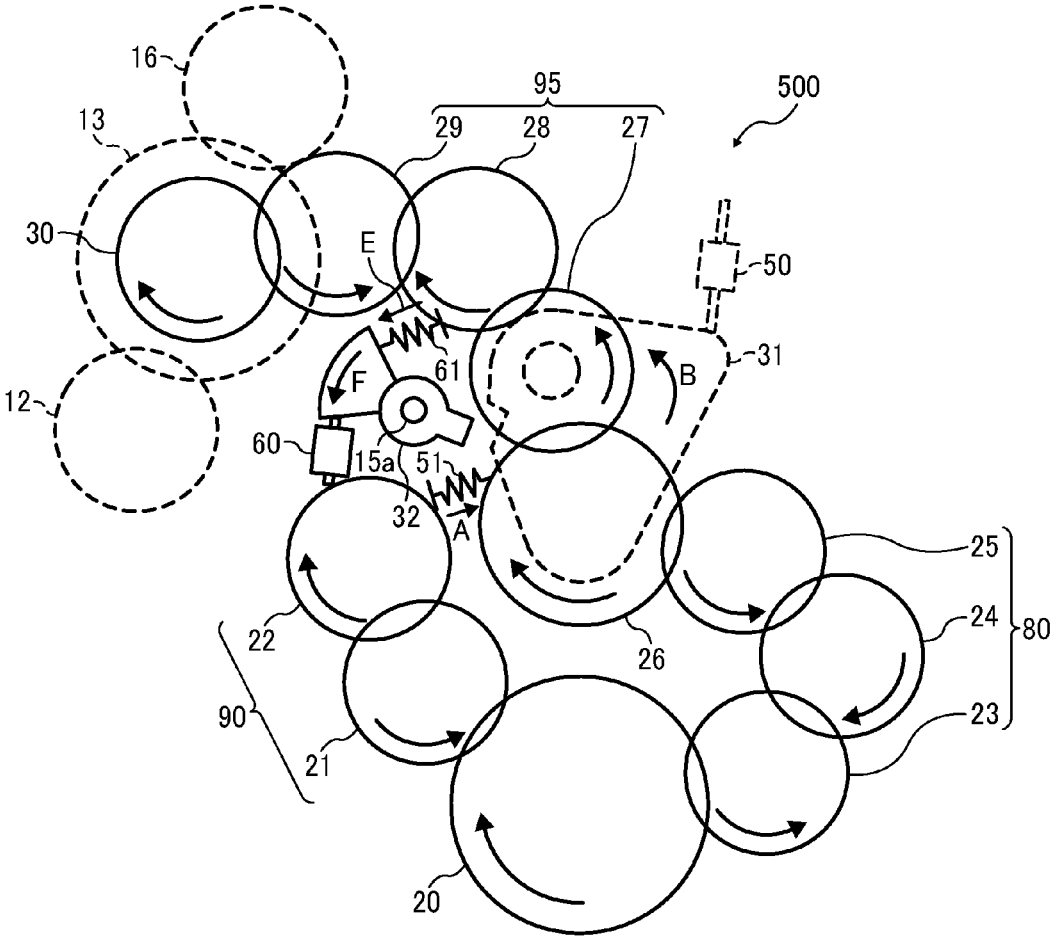
FIG. 3 is an explanatory diagram of a gear train forming a sheet discharge drive transmission device of the sheet feeder, wherein a first solenoid is OFF.
Figure 4:
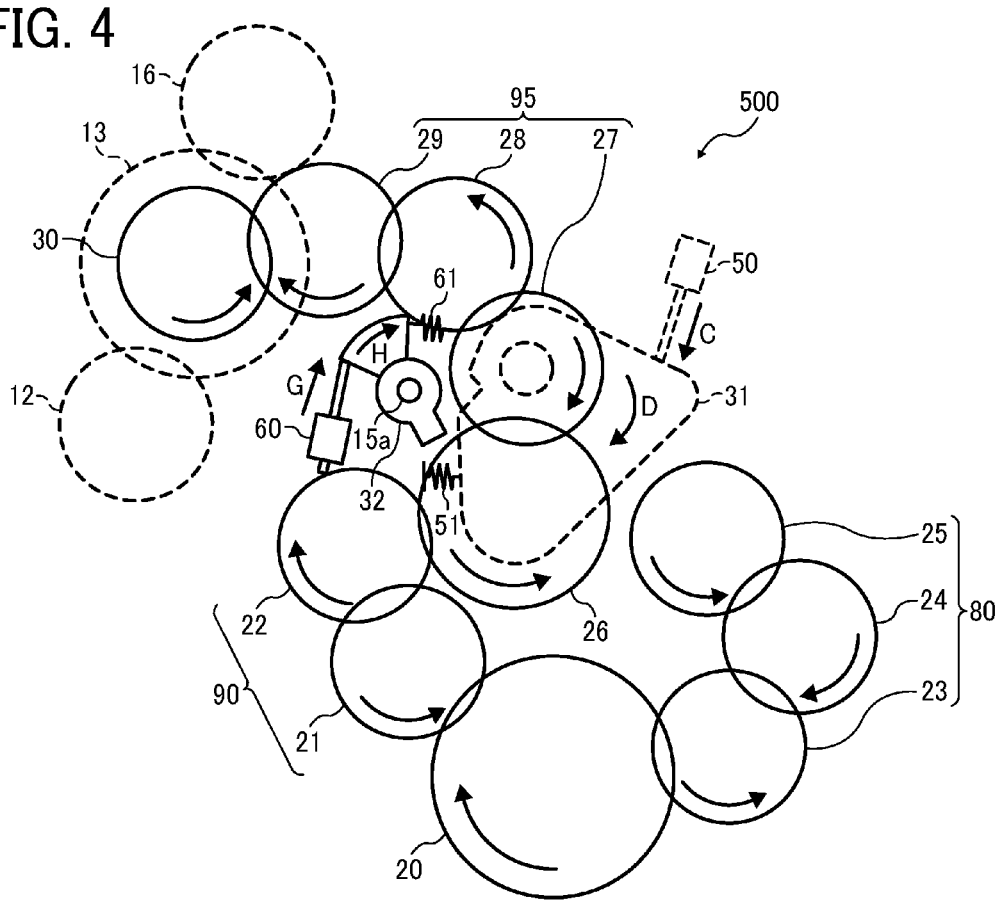

A description will now be given of a drive transmission device which transmits rotational drive to the sheet discharge roller 13 from the first motor 101. FIG. 3 is an explanatory diagram of a gear train forming a sheet discharge drive transmission device 500 serving as the drive transmission device which transmits rotational drive to the sheet discharge roller 13. FIG. 3 is an explanatory diagram illustrating the gear train in an OFF state of a first solenoid 50 (also referred to as a movable gear moving mechanism), in which the first solenoid 50 is not supplied with current, and FIG. 4 is an explanatory diagram illustrating the gear train in an ON state of the first solenoid 50, in which the first solenoid 50 is supplied with current. The first motor 101 is connected to the fixing drive gear 20 by a not-illustrated gear train. While being supplied with current, the first motor 101 constantly generates rotational drive rotating in a fixed direction. While the first motor 101 is supplied with current, therefore, the fixing drive gear 20 rotates in a fixed direction.

The sheet discharge drive transmission device 500 mainly includes the fixing drive gear 20, a first sheet discharge gear train 80 (also referred to as a first drive transmission gear train), a second sheet discharge gear train 90 (also referred to as a second drive transmission gear train), a sheet discharge transmission gear train 95 (also referred to as a downstream gear train), a planetary gear 26 (also referred to as a movable gear), a link member 31 (also referred to as a movable gear supporting member), a lock member 32 (also referred to as a hitting member), the first solenoid 50, a link pressing spring 51, a second solenoid 60 (also referred to as a hitting member moving mechanism), and a lock pressing spring 61. As illustrated in FIGS. 3 and 4, in a gear train forming the sheet discharge drive transmission device 500, the extreme upstream gear in the drive transmission direction is the fixing drive gear 20. The first sheet discharge gear train 80 includes an odd number of gears, and forms a first path for transmitting the rotational drive of the fixing drive gear 20. The second sheet discharge gear train 90 includes an even number of gears, and forms, separately from the first path of the first sheet discharge gear train 80, a second path for transmitting the rotational drive of the fixing drive gear 20. The first sheet discharge gear train 80 includes three gears, i.e., a first gear train upstream gear 23, a first gear train central gear 24, and a first gear train downstream gear 25 (also referred to as a first output gear). The second sheet discharge gear train 90 includes two gears, i.e., a second gear train upstream gear 21 and a second gear train downstream gear 22 (also referred to as a second output gear). The sheet discharge transmission gear train 95, which is constantly connected to the sheet discharge drive gear 30, includes a first transmission gear 27, a second transmission gear 28, and a third transmission gear 29.

The planetary gear 26 is movable between a first drive transmission position and a second drive transmission position. The planetary gear 26 meshes with the first gear train downstream gear 25 at the first drive transmission position, and the meshes with the second gear train downstream gear 22 at the second drive transmission position. Located at the first drive transmission position or the second drive transmission position, the planetary gear 26 transmits drive to the sheet discharge transmission gear train 95, which inputs the drive to the sheet discharge roller 13.

The planetary gear 26 is rotatably supported by the link member 31 supported relative to the device body to be rotatable around a first transmission gear shaft 27*a* (see FIG. 10), which serves as a rotary shaft of the first transmission gear 27, as the center of rotation. In accordance with the swing of the link member 31, the planetary gear 26 moves between the first drive transmission position and the second drive transmission position.

The link member 31 is connected to the link pressing spring 51 and the first solenoid 50. As illustrated in FIG. 3, in the OFF state of the first solenoid 50, in which the first solenoid 50 is not supplied with current, the link pressing spring 51 presses the link member 31 in the direction of an arrow A in FIG. 3, and force in a rotation direction indicated by an arrow B in FIG. 3 acts on the link member 31. As a result, the link member 31 strikes first solenoid 50, with the planetary gear 26 meshing with the first gear train downstream gear 25. Thereby, the planetary gear 26 is fixed at the first drive transmission position.

As illustrated in FIG. 4, in the ON state of the first solenoid 50, in which the first solenoid 50 is supplied with current, the first solenoid 50 presses the link member 31 in the direction of an arrow C in FIG. 4 against the pressing force of the link pressing spring 51, and force in a rotation direction indicated by an arrow D in FIG. 4 acts on the link member 31. Then, a pressing member, i.e., a plunger of the first solenoid 50 is fully extended, with the planetary gear 26 meshing with the second gear train downstream gear 22. Thereby, the planetary gear 26 is fixed at the second drive transmission position.

In the above-described manner, the link member 31 rotates in accordance with the ON and OFF control of the first solenoid 50. Further, in the OFF state of the first solenoid 50, in which the first solenoid 50 is not supplied with current, the planetary gear 26 meshes with the first gear train downstream gear 25 to be coupled thereto. In the ON state of the first solenoid 50, in which the first solenoid 50 is supplied with current, the planetary gear 26 meshes with the second gear train downstream gear 22 to be coupled thereto.

In the sheet discharge drive transmission device 500, when the fixing drive gear 20 rotates in the clockwise direction in FIGS. 3 and 4, the first gear train downstream gear 25 rotates in the counterclockwise direction, and the second gear train downstream gear 22 rotates in the clockwise direction. In the state illustrated in FIG. 3, the planetary gear 26 is in mesh with the first gear train downstream gear 25. In this state, the rotational drive of the first gear train downstream gear 25 is transmitted to the sheet discharge transmission gear train 95, and then to the sheet discharge drive gear 30 meshing with the third transmission gear 29 of the sheet discharge transmission gear train 95. Thereby, the sheet discharge roller 13 integrally fixed to the sheet discharge drive gear 30 via the rotary shaft thereof is rotated in the clockwise direction in FIG. 3. Meanwhile, in the state illustrated in FIG. 4, the planetary gear 26 is in mesh with the second gear train downstream gear 22. In this state, the rotational drive of the second gear train downstream gear 22 is transmitted to the sheet discharge transmission gear train 95, and then to the sheet discharge drive gear 30. Thereby, the sheet discharge roller 13 is rotated in the counterclockwise direction in FIG. 4.

With the above-described configuration, in the OFF state of the first solenoid 50, in which the first solenoid 50 is not supplied with current, the sheet discharge roller 13 rotates in the clockwise direction, as illustrated in FIG. 3. Further, in the ON state of the first solenoid 50, in which the first solenoid 50 is supplied with current, the sheet discharge roller 13 rotates in the counterclockwise direction, as illustrated in FIG. 4. Thereby, the sheet discharge driven roller 12 or the reverse driven roller 16 in pressure-contact with the sheet discharge roller 13 rotates, and allows the sheet P1 to be fed through the sheet discharge nip or the reversing nip.

The lock member 32 strikes against a part of the link member 31, and thereby stops the movement of the planetary gear 26 moving from the first drive transmission position toward the second drive transmission position. The lock member 32 is supported relative to the device body to be rotatable around the branching member shaft 15*a* as the center of rotation. The lock member 32 is connected to the lock pressing spring 61 and the second solenoid 60 which moves the lock member 32 between a hitting position and a retreat position. In the state illustrated in FIG. 3, the second solenoid 60 is in the OFF state, in which the second solenoid 60 is not supplied with current. In this state, the lock pressing spring 61 presses the lock member 32 in the direction of an arrow E in FIG. 3, and force in a rotation direction indicated by an arrow F in FIG. 3 acts on the lock member 32. Thereby, the lock member 32 strikes the second solenoid 60, and the position of the lock member 32 is fixed. In the state illustrated in FIG. 4, the second solenoid 60 is in the ON state, in which the second solenoid 60 is supplied with current. In this state, the second solenoid 60 presses the lock member 32 in the direction of an arrow G in FIG. 4 against the pressing force of the lock pressing spring 61. Thereby, force in a rotation direction indicated by an arrow H in FIG. 4 acts on the lock member 32, and the position of the lock member 32 is fixed, with a pressing member, i.e., a plunger of the second solenoid 60 fully extended.

Figure 5:
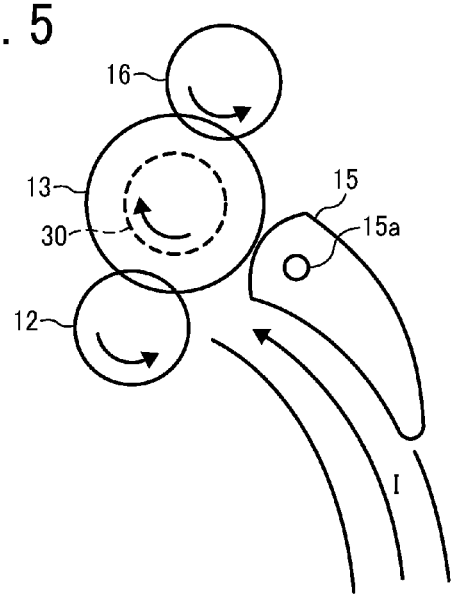
FIG. 5 is an enlarged explanatory diagram of an area near a branching member in a case where a sheet is guided to a sheet discharge nip.

A description will now be given of switching between the sheet feed paths and a sheet reversing mechanism. FIG. 5 is an enlarged explanatory diagram of an area near the branching member 15 in a case where the sheet P1 is guided to the sheet discharge nip. As indicated by an arrow I in FIG. 5, the sheet P1 fed from below is guided to the sheet discharge nip by the branching member 15, and is discharged to the discharged sheet stacking unit 14 through the sheet discharge nip. In this process, the first solenoid 50 is in the OFF state, and the sheet discharge roller 13 rotates in the clockwise direction in FIG. 5. Further, the position of the branching member 15 relative to the lock member 32 is fixed, and thus the branching member 15 rotates together with the lock member 32 around the branching member shaft 15*a* as the center of rotation. Further, in the state illustrated in FIG. 5, the second solenoid 60 is in the OFF state, and the lock member 32 is in the state illustrated in FIG. 3.

Figure 6:
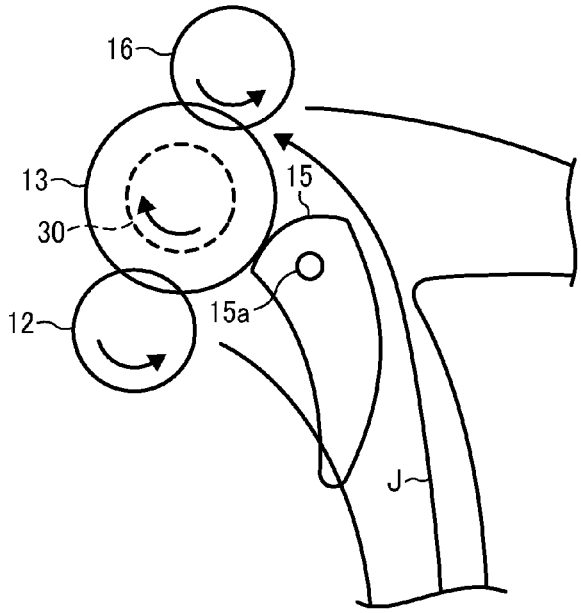
FIG. 6 is an enlarged explanatory diagram of the area near the branching member in a case where a sheet is guided to a reversing nip.

A description will now be given of a case where duplex printing is performed. FIG. 6 is an enlarged explanatory diagram of the area near the branching member 15 in a case where the sheet P1 is guided to the reversing nip. When the second solenoid 60 in the state illustrated in FIGS. 1 and 5 is turned ON, the lock member 32 rotates around the branching member shaft 15*a* in the clockwise direction, as indicated by the arrow H in FIG. 4. As described above, the position of the branching member 15 relative to the lock member 32 is fixed. In this process, therefore, the branching member 15 in the state illustrated in FIG. 5 also rotates around the branching member shaft 15*a* in the clockwise direction, and blocks the first feed path for feeding the sheet P1 to the sheet discharge nip, as illustrated in FIG. 6. Thereby, the sheet P1 fed from below is guided to the reversing nip, as indicated by an arrow J in FIG. 6. The branching member 15 and the branching member shaft 15*a* are integrally configured over the entire area in the width direction of the sheet P1, i.e., in a direction perpendicular to the drawing plane.

Figure 7:
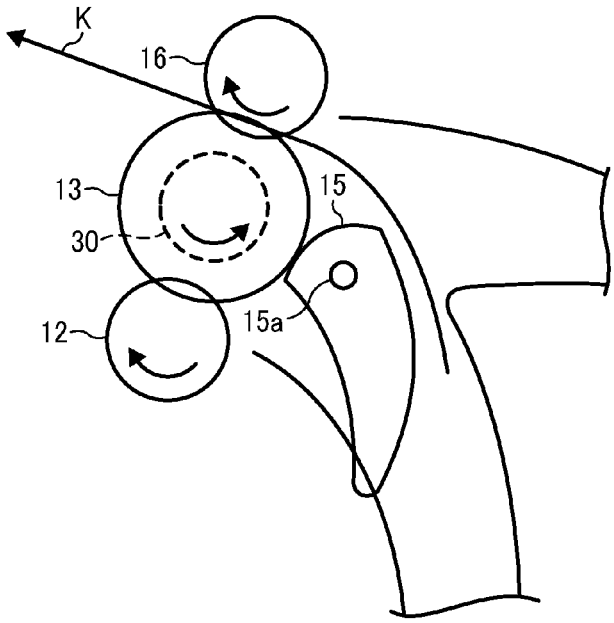
FIG. 7 is an enlarged explanatory diagram of the area near the branching member in a state in which a sheet has entered the reversing nip.

To guide the sheet P1 to the reversing nip, the first solenoid 50 is also turned ON after the second solenoid 60 is turned ON. FIG. 7 is an enlarged explanatory diagram of the area near the branching member 15 in a state in which the sheet P1 has entered the reversing nip. When the first solenoid 50 in the state illustrated in FIGS. 1 and 5 is turned ON, the planetary gear 26 meshes with the second gear train downstream gear 22, as illustrated in FIG. 4. Then, the sheet discharge roller 13 rotates in the counterclockwise direction (also referred to as a first rotation direction), as illustrated in FIG. 7. Thereby, the sheet P1 guided by the branching member 15 is applied with feeding force in the direction of causing the sheet P1 to pass through the reversing nip (also referred to as a first feeding direction), as indicated by an arrow K in FIG. 7.

Figure 8:
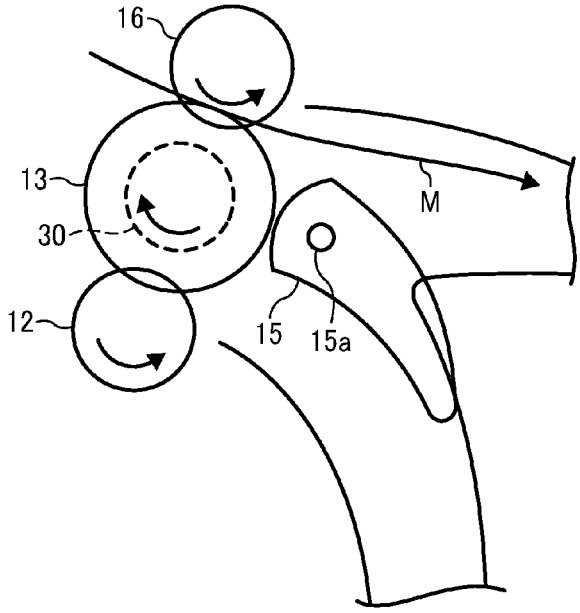
FIG. 8 is an enlarged explanatory diagram of the area near the branching member in a state resulting from turn-OFF of the first solenoid and a second solenoid in the state illustrated in FIG. 7.

Thereafter, the first solenoid 50 and the second solenoid 60 are turned OFF immediately before the rear end of the sheet P1 reaches the reversing nip. With the first solenoid 50 turned OFF immediately before the rear end of the sheet P1 reaches the reversing nip, the sheet discharge roller 13 rotates in the clockwise direction (also referred to as a second rotation direction), as illustrated in FIG. 8. Thereby, the sheet P1 nipped in the reversing nip is applied with feeding force opposite in direction to the feeding force applied to the sheet P1 so far. Further, with the second solenoid 60 turned OFF immediately before the rear end of the sheet P1 reaches the reversing nip, the branching member 15 is placed in the state illustrated in FIG. 8 after the rear end of the sheet P1 has passed by the branching member 15, which guides the sheet P1. Thereby, the sheet P1 nipped in the reversing nip and applied with the feeding force opposite in direction to the feeding force applied to the sheet P1 so far is fed in the direction toward the duplex feed path 70 (also referred to as a second feeding direction), as indicated by an arrow M in FIG. 8, without being fed toward the fixing nip.

Figure 9:
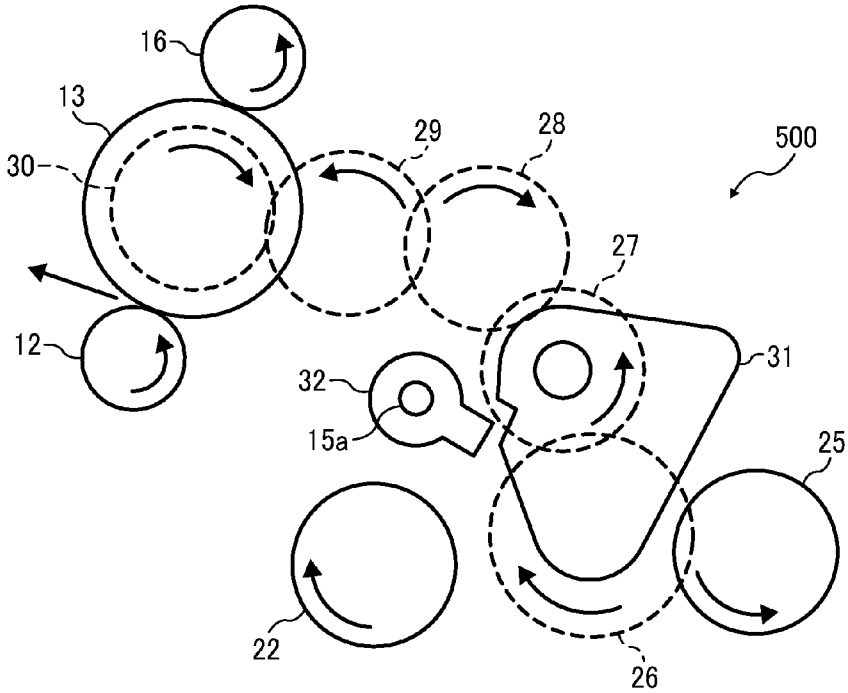
FIG. 9 is an explanatory diagram of a gear train downstream of a first drive transmission position and a second drive transmission position in a first combination.

A description will now be given of combinations of the position of the planetary gear 26 and the position of the lock member 32 according to the combination of ON and OFF of the first solenoid 50 and the second solenoid 60. FIG. 9 is an explanatory diagram of a gear train downstream of the first and second drive transmission positions of the sheet discharge drive transmission device 500 in a first combination. The illustration of the first solenoid 50, the link pressing spring 51, the lock pressing spring 61, and the second solenoid 60 is omitted in FIG. 9. The illustration of a fan-shaped portion of the lock member 32 connected to the lock pressing spring 61 and the second solenoid 60 is also omitted in FIG. 9.

In the first combination illustrated in FIG. 9, the first solenoid 50 and the second solenoid 60 are both in the OFF state. With the first solenoid 50 placed in the OFF state, the planetary gear 26 is in mesh with the first gear train downstream gear 25. Therefore, the sheet discharge roller 13 rotates in the clockwise direction. Further, with the second solenoid 60 placed in the OFF state, the lock member 32 configured integrally with the branching member shaft 15*a* is held at a position at which the lock member 32 is not in contact with the link member 31, as illustrated in FIG. 9. In the first combination, the rotation direction of the sheet discharge roller 13, the position of the branching member 15, and the sheet P1 have the relationship illustrated in FIG. 5 or the relationship illustrated in FIG. 8.

Figure 10:
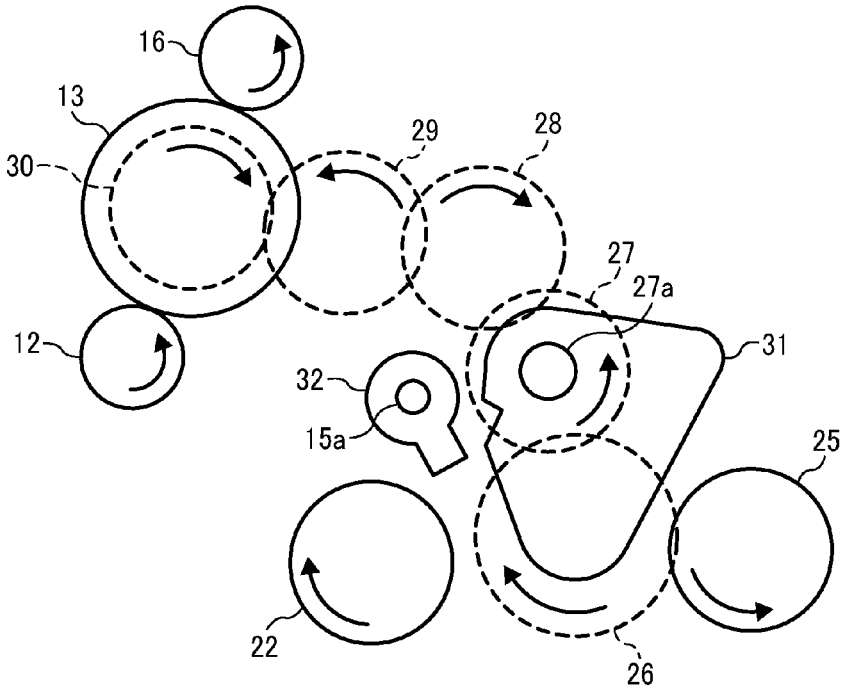
FIG. 10 is an explanatory diagram of the gear train downstream of the first drive transmission position and the second drive transmission position in a second combination.

FIG. 10 is an explanatory diagram of the gear train downstream of the first and second drive transmission positions of the sheet discharge drive transmission device 500 in a second combination. The illustration of the link pressing spring 51, the lock pressing spring 61, the first solenoid 50, the second solenoid 60, and the fan-shaped portion of the lock member 32 is also omitted in FIG. 10 as in FIG. 9.

The second combination is obtained by turning ON the second solenoid 60 in the first combination. In this state, the lock member 32 in the first combination rotates around the branching member shaft 15*a* in the clockwise direction, but is not in contact with the link member 31. Further, with the first solenoid 50 remaining in the OFF state, the planetary gear 26 is in mesh with the first gear train downstream gear 25. Therefore, the sheet discharge roller 13 rotates in the clockwise direction. In the second combination, the rotation direction of the sheet discharge roller 13, the position of the branching member 15, and the sheet P1 have the relationship illustrated in FIG. 6.

Figure 11:
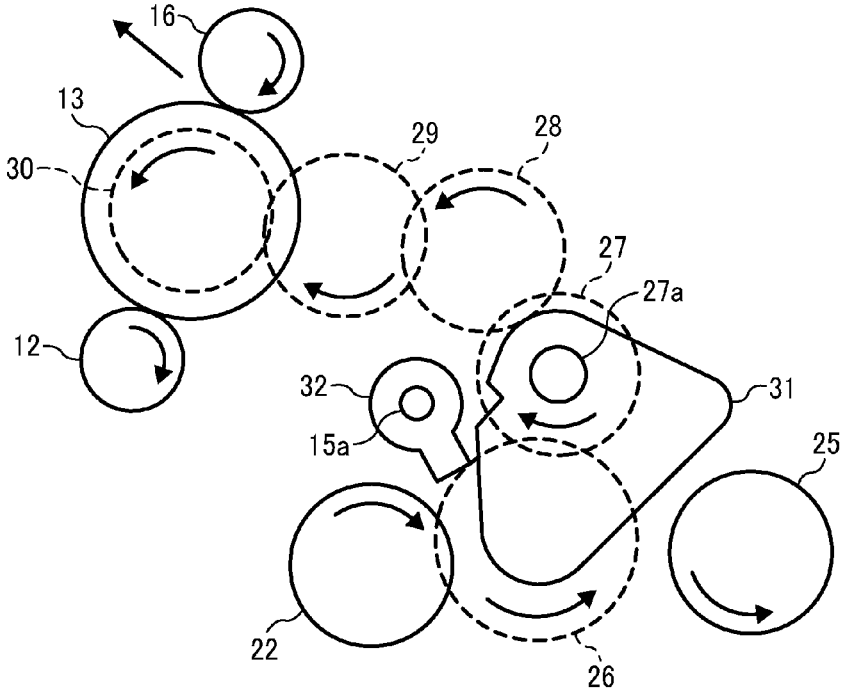
FIG. 11 is an explanatory diagram of the gear train downstream of the first drive transmission position and the second drive transmission position in a third combination.

FIG. 11 is an explanatory diagram of the gear train downstream of the first and second drive transmission positions of the sheet discharge drive transmission device 500 in a third combination. The illustration of the link pressing spring 51, the lock pressing spring 61, the first solenoid 50, the second solenoid 60, and the fan-shaped portion of the lock member 32 is also omitted in FIG. 11 as in FIG. 9.

The third combination is obtained by turning ON the first solenoid 50 in the second combination, with the second solenoid 60 kept in the ON state, i.e., with the lock member 32 kept in the same posture as in the second combination. The first solenoid 50 in the second combination is turned ON, and thereby the link member 31 in the second combination rotates around the first transmission gear shaft 27*a* in the clockwise direction, but the link member 31 and the lock member 32 are not in contact with each other. Further, with the first solenoid 50 placed in the ON state, the planetary gear 26 meshes with the second gear train downstream gear 22. As a result, the sheet discharge roller 13 rotates in the counterclockwise direction. In the third combination, the rotation direction of the sheet discharge roller 13, the position of the branching member 15, and the sheet P1 have the relationship illustrated in FIG. 7.

Figure 12:
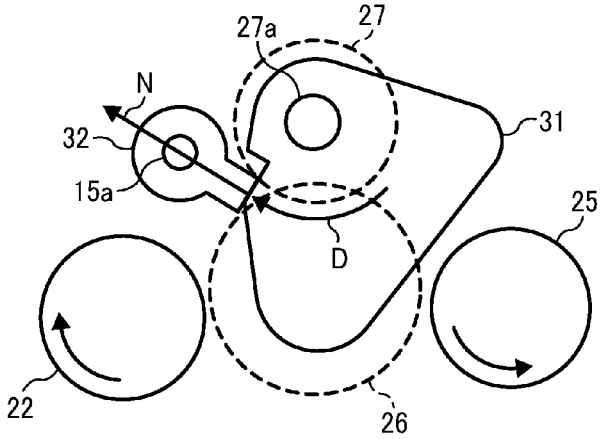
FIG. 12 is an explanatory diagram of an area near a planetary gear in a fourth combination.

FIG. 12 is an explanatory diagram of an area near the planetary gear 26 of the gear train of the sheet discharge drive transmission device 500 in a fourth combination. The illustration of the link pressing spring 51, the lock pressing spring 61, the first solenoid 50, the second solenoid 60, and the fan-shaped portion of the lock member 32 is also omitted in FIG. 12 as in FIG. 9.

The fourth combination is obtained by turning ON the first solenoid 50 in the first combination, with the second solenoid 60 kept in the OFF state. With the first solenoid 50 in the first combination turned ON, the link member 31 in the first combination rotates around the first transmission gear shaft 27*a* in the clockwise direction, and comes into contact with the lock member 32 before the planetary gear 26 reaches the second drive transmission position at which the planetary gear 26 meshes with the second gear train downstream gear 22. With this contact, the lock member 32 interferes with the movement in the direction of the arrow D of the link member 31 pressed by the first solenoid 50, and the planetary gear 26 is held at a idle position at which the planetary gear 26 does not mesh with either the first gear train downstream gear 25 or the second gear train downstream gear 22. In the fourth combination, the rotational drive is not transmitted to the planetary gear 26, and thus the sheet discharge roller 13 stops rotating. Consequently, it is possible to stop the feeding of the sheet P1 by the sheet discharge roller 13, even if there is an input of the rotational drive from the first motor 101. In the fourth combination, the leading end of the sheet P1 having passed the duplex feed path 70 is standing by at the registration nip.

TABLE 1 illustrates steps of a sheet reversing operation in duplex printing and the ON and OFF states of the first solenoid 50 and the second solenoid 60 used therein.

TABLE 1

| Major steps of sheet reversing operation | Combination | Position of sheet | First solenoid 50 | Second solenoid 60 |
|---|---|---|---|---|
| Leading end of sheet has not reached branching member 50 | 1 | FIG. 5 | OFF | OFF |
| Leading end of sheet is passing branching member 50 | 2 | FIG. 6 | OFF | ON |
| Leading end of sheet is passing reversing nip | 3 | FIG. 7 | ON | ON |
| Sheet is being fed to duplex feed path 70 | 1 | FIG. 8 | OFF | OFF |

Normally, the steps of the first to third combinations are repeated in the sheet reversing operation. In the fourth combination for stopping the drive of the sheet discharge roller 13, which has been described above with reference to FIG. 12, the first solenoid 50 is ON, and the second solenoid 60 is OFF. Therefore, the ON and OFF combinations are efficiently used, with the fourth combination not overlapping with any of the first to third combinations illustrated in TABLE 1.

In the fourth combination illustrated in FIG. 12, a surface of the lock member 32 and a surface of the link member 31 are in contact with each other, and the surfaces are both perpendicular to a tangent of the rotation direction of the link member 31, i.e., perpendicular to the direction of an arrow N in FIG. 12. Thus, the lock member 32 and the link member 31 maintain relative positions in which a planar surface of the lock member 32 and a planar surface of the link member 31 both perpendicular to the tangential direction are in contact with each other. Due to this relationship, the rotation vector of the link member 31 passes through the center of rotation of the lock member 32, and the lock member 32 is not applied with unnecessary rotational moment. Accordingly, the positional accuracy is maintained.

Figure 13:
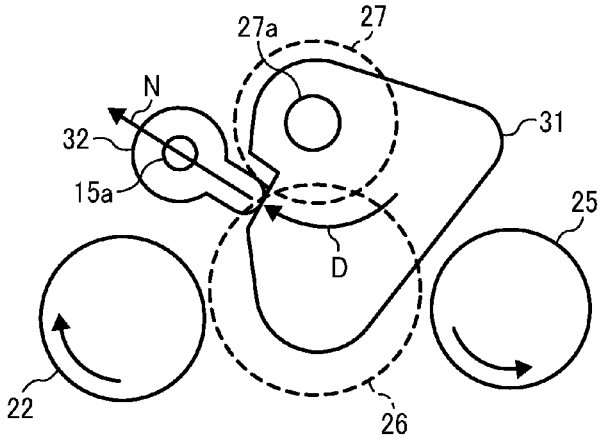
FIG. 13 is an explanatory diagram of a configuration in the fourth combination, in which a contact portion of a lock member in contact with a link member has a circular arc shape.

The area of contact of the lock member 32 and the link member 31 is not limited to the planar surface. FIG. 13 is an explanatory diagram of a configuration in which the lock member 32 has a circular arc-shaped contact portion which comes into contact with the link member 31. As illustrated in FIG. 13, with the lock member 32 having the circular arc-shaped contact portion which comes into contact with the link member 31, the area of contact is limited to one point, and the positional accuracy is further improved. Further, as described above, the relative positions of the lock member 32 and the link member 31 preferably are such that unnecessary rotational moment is not applied to the lock member 32 at the position of contact.

Figure 14:
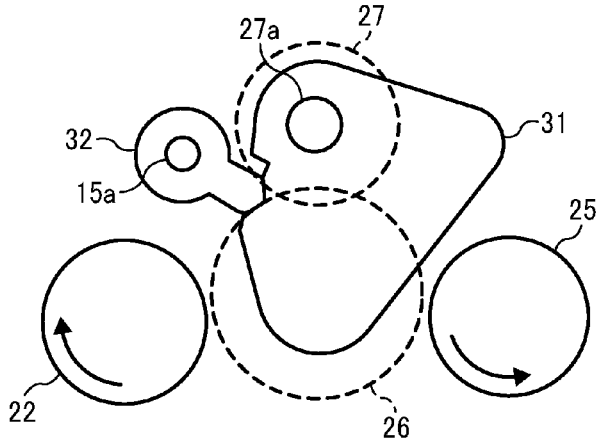
FIG. 14 is an explanatory diagram of a configuration in the fourth combination, in which a contact portion of the lock member and a contact portion of the link member are engaged with each other in a wedge shape.

FIG. 14 is an explanatory diagram of a configuration in which the respective contact portions of the lock member 32 and the link member 31 engage with each other in a wedge shape. The lock member 32 and the link member 31, each of which is movable around the rotary shaft thereof in the rotation direction, are regulated in movement in the rotation direction, when meshing with each other in the wedge shape. Therefore, the positional accuracy is improved. Further, in the fourth combination, the possibility of the planetary gear 26 coming into contact with another gear is reduced, and thus both noise and gear damage are prevented.

Further, in a conventional laser printer, a fixing roller needs to keep rotating, even when not feeding a sheet, until residual heat is removed, and the fixing roller is not allowed to be stopped, even for a relatively short period of time, to perform precise temperature control. Due to such restrictions, a configuration having a drive source shared by a sheet discharge roller and a fixing roller, such as the printer 100, is unable to stop the sheet discharge roller during the rotation of the fixing roller, unless the drive source and the sheet discharge roller are connected by a clutch, for example. Meanwhile, the printer 100 according to the present embodiment is capable of stopping the sheet discharge roller 13 even during the rotation of the fixing roller 10 by shifting to the fourth combination.

Figure 15:
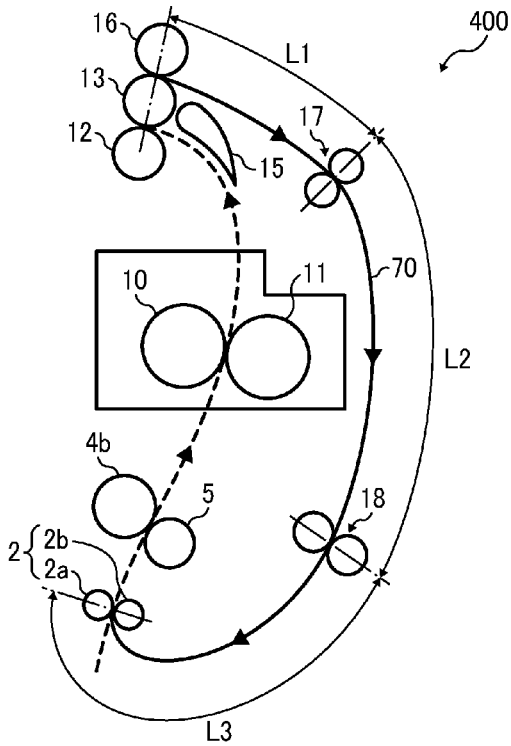
FIG. 15 is an explanatory diagram illustrating the distances between rollers on a duplex feed path.

FIG. 15 is an explanatory diagram illustrating the distances between the rollers on the duplex feed path 70. As illustrated in FIG. 15, L1 represents the distance between the reversing nip and the duplex entrance nip, and L2 represents the distance between the duplex entrance nip and the duplex exit nip. Further, L3 represents the distance between the duplex exit nip and the registration nip, and the length of the sheet P1 is represented as Lp (not illustrated).

In duplex printing, the sheet P1 reaches the registration nip through the duplex feed path 70 having a length corresponding to the sum of the distances L1 to L3, and is subjected to skew correction. After the skew correction of the sheet P1 is completed, the duplex clutch is turned OFF to stop the duplex exit drive roller 18*a* and the duplex entrance drive roller 17*a* for a time T0 (seconds) (not illustrated). Then, the duplex clutch is turned ON at the same time as the registration drive roller 2*a* starts moving again, to thereby cause the duplex exit drive roller 18*a* and the duplex entrance drive roller 17*a* to start feeding the sheet P1. Thereafter, an operation similar to the operation of the above-described simplex printing is performed.

Herein, if the length Lp of the sheet P1 exceeds the length of the duplex feed path 70 corresponding to the sum of the distances L1, L2, and L3, the rear end of the sheet P1 protrudes from the reversing nip, even when the leading end of the sheet P1 fed from the duplex feed path 70 has reached the registration nip. In this state, the fixing roller 10 is not allowed to stop rotating, and thus the sheet discharge roller 13 is also rotating. As described above, after the sheet P1 reaches the registration nip and the skew correction is completed in duplex printing, the duplex exit drive roller 18*a* and the duplex entrance drive roller 17*a* are stopped for the time T0. If the sheet discharge roller 13 and the reverse driven roller 16 forming the reversing nip continue to rotate during the time T0, the sheet P1 sags between the reversing nip and the duplex entrance nip.

If the amount of the sag is small enough that it can be safely ignored, there is no problem. However, if the printer 100 performs, for example, an operation of suspending the image formation for a relatively long time, the registration drive roller 2*a*, the duplex exit drive roller 18*a*, and the duplex entrance drive roller 17*a* are not allowed to start rotating during that time. As a result, the amount of the above-described sag is excessively increased, and the sheet P1 suffers substantial damage in the duplex feed path 70.

After the sheet P1 reaches the registration nip and the skew correction is completed, therefore, the printer 100 according to the present embodiment stops driving the duplex entrance drive roller 17*a* and the duplex exit drive roller 18*a*, which respectively form the duplex entrance nip and the duplex exit nip downstream of the reversing nip, and shifts drive transmission to the sheet discharge roller 13 to the fourth combination to disconnect the drive transmission. Thereby, the damage to the sheet P1 is prevented.

Figure 16:
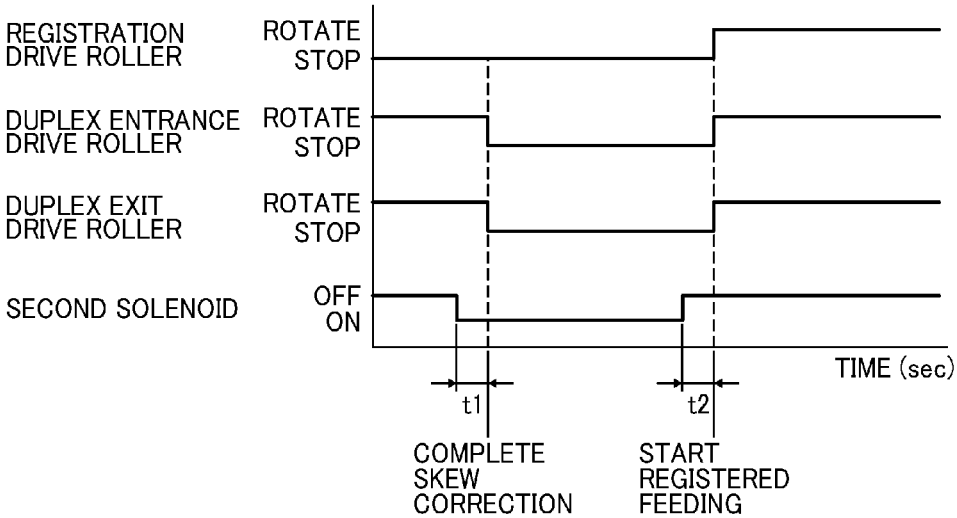
FIG. 16 is a timing chart illustrating control timing of rotation and stop of roller members and ON and OFF timing of a solenoid.

FIG. 16 is a timing chart illustrating control timing of the rotation and stop of the registration drive roller 2*a*, the duplex entrance drive roller 17*a*, and the duplex exit drive roller 18*a*, and ON and OFF timing of the second solenoid 60.

In general, it takes time to complete the operation of a solenoid by fully drawing out a plunger from the solenoid. Thus, it is desired to take the resultant time lag into consideration in designing the control. After the leading end of the sheet P1 fed from the duplex fed path 70 reaches the registration nip and the skew correction is completed, the rotation of the duplex entrance drive roller 17*a* and the duplex exit drive roller 18*a* is stopped, and at the same time the sheet discharge roller 13 is stopped. To stop the sheet discharge roller 13 while keeping the fixing roller 10 driven to rotate, the drive transmission to the sheet discharge roller 13 is shifted to the fourth combination. To shift to the fourth combination from the first combination, in which the reversed sheet P1 is being fed to the duplex feed path 70 serving as the reversed sheet feed path, the second solenoid 60 is turned ON, and thereafter the first solenoid 50 is also turned ON.

Therefore, an ON signal is transmitted to the second solenoid 60 faster than the stop of the above-described duplex entrance drive roller 17*a* and duplex exit drive roller 18*a* by a necessary time t1 taken to complete the solenoid operation performed when turning ON the second solenoid 60 and thereafter turning ON the first solenoid 50. Thereby, the rotation of the sheet discharge roller 13 is highly accurately synchronized with the rotation of the rollers downstream thereof, i.e., the duplex entrance drive roller 17*a* and the duplex exit drive roller 18*a*. Similarly, an OFF signal is transmitted faster than the start of rotation of the duplex entrance drive roller 17*a* and the duplex exit drive roller 18*a* by a necessary time t2 taken to complete the solenoid operation performed when turning OFF the first solenoid 50 and the second solenoid 60. Thereby, unnecessary sagging of the sheet P1 is prevented.

In the present embodiment, the fixing drive gear 20, the first sheet discharge gear train 80, the planetary gear 26, and the sheet discharge transmission gear train 95 form a first gear train which transmits the drive to the sheet discharge roller 13 serving as the drive target when the planetary gear 26 serving as the movable gear is located at the first drive transmission position. Further, the fixing drive gear 20, the second sheet discharge gear train 90, the planetary gear 26, and the sheet discharge transmission gear train 95 form a second gear train which transmits the drive to the sheet discharge roller 13 serving as the drive target when the planetary gear 26 is located at the second drive transmission position. As described above, the present embodiment is configured such that the first gear train and the second gear train share the sheet discharge transmission gear train 95 as a gear train closer to the drive target than the movable gear is. Each of the first gear train and the second gear train, however, may be provided with a gear train closer to the drive target than the movable gear is.

The above-described embodiments are illustrative and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. A drive transmission device, comprising:

a gear train that transmits rotational drive input from a drive source to a drive target, the gear train including a first gear train that forms a first transmission path for transmitting the rotational drive to the drive target, a second gear train that forms a second transmission path for transmitting the rotational drive to the drive target as rotational drive opposite in rotation direction to the rotational drive transmitted by the first gear train, and a movable gear movable between a first drive transmission position at which the movable gear forms a part of the first gear train and causes the first gear train to transmit the rotational drive to the drive target and a second drive transmission position at which the movable gear forms a part of the second gear train and causes the second gear train to transmit the rotational drive to the drive target;

a movable gear locking device that locks the movable gear at an idle position, which is located at a position different from the first drive transmission position and the second drive transmission position, between the first drive transmission position and the second drive transmission position;

a movable gear supporting member that rotatably supports the movable gear; and a movable gear moving mechanism that, when in an OFF state, places the movable gear at the first drive transmission position, and that, when in an ON state, moves the movable gear supporting member and thereby place the movable gear at the second drive transmission position, wherein the movable gear locking device includes:

a hitting member that strikes a contact portion of the movable gear supporting member, to thereby cause the movable gear moving from the first drive transmission position toward the second drive transmission position to stop at the idle position, and a hitting member moving mechanism that, when in one of an ON state and an OFF state, places the hitting member at a hitting position at which the hitting member strikes the contact portion, and that, when in the other one of the ON state and the OFF state, places the hitting member at a retreat position at which the hitting member does not strike the contact portion.

2. The drive transmission device according to claim 1, wherein the gear train further includes:

a drive input gear serving as an extreme upstream gear of the gear train in a drive transmission direction, a first drive transmission gear train that forms a first path for transmitting the rotational drive of the drive input gear to the movable gear, and includes a first output gear serving as an extreme downstream gear of the first drive transmission gear train in the drive transmission direction and meshing with the movable gear at the first drive transmission position, a second drive transmission gear train that forms, separately from the first path, a second path for transmitting the rotational drive of the drive input gear to the movable gear, that includes a second output gear serving as an extreme downstream gear of the second drive transmission gear train in the drive transmission direction and meshing with the movable gear at the second drive transmission position, and that includes an even number of gears when the first drive transmission gear train includes an odd number of gears, and include an odd number of gears when the first drive transmission gear train includes an even number of gears, and a downstream gear train that transmits the rotational drive of the movable gear to the drive target, and wherein the first gear train includes the drive input gear, the first drive transmission gear train, the movable gear, and the downstream gear train, and the second gear train includes the drive input gear, the second drive transmission gear train, the movable gear, and the downstream gear train.

3. The drive transmission device according to claim 2, wherein the contact portion of the movable gear supporting member comprises a surface perpendicular to the moving direction of the movable gear moving from the first drive transmission position to the second drive transmission position.

4. The drive transmission device according to claim 2, wherein one of the contact portion of the movable gear supporting member and a portion of the hitting member hitting against each other comprises a circular-arc projecting shape.

5. The drive transmission device according to claim 2, wherein one of the contact portion of the movable gear supporting member and a portion of the hitting member striking each other comprises a recessed wedge shape, and the other one thereof comprises a projecting wedge shape dimensioned to fit in the recessed wedge shape.

6. A sheet feeder comprising:

a sheet feed path that receives a sheet;

a reverse sheet feed roller that contacts the sheet in the sheet feed path and rotate in a first rotation direction to feed the sheet in a first feeding direction, and that contacts the sheet in the sheet feed path and rotate in a second rotation direction opposite to the first rotation direction to feed the sheet in a second feeding direction; and the drive transmission device according to claim 1, which transmits rotational drive in one of the first rotation direction and the second rotation direction to the reverse sheet feed roller serving as a drive target.

7. An image forming apparatus comprising:

an image forming unit that forms an image on a sheet; and a sheet feeder according to claim 6, configured to feed the sheet inside the image forming apparatus.

8. A sheet feeder comprising:

a sheet feed path that receives a sheet;

a reverse sheet feed roller that contacts the sheet in the sheet feed path and rotate in a first rotation direction to feed the sheet in a first feeding direction, and that contacts the sheet in the sheet feed path and rotate in a second rotation direction opposite to the first rotation direction to feed the sheet in a second feeding direction;

the drive transmission device according to claim 1, which transmits rotational drive in one of the first rotation direction and the second rotation direction to the reverse sheet feed roller serving as a drive target; and a branching member movable between a first position for guiding the sheet fed from upstream to a first feed path and a second position for guiding the sheet fed from upstream to a second feed path, the branching member located at the first position in one of the ON state and the OFF state of the hitting member moving mechanism, and located at the second position in the other one of the ON state and the OFF state of the hitting member moving mechanism.

9. The sheet feeder according to claim 8, further comprising:

a first driven roller that contacts the reverse sheet feed roller to form a first feed nip, and configured to rotate in accordance with the rotation of the reverse sheet feed roller; and a second driven roller that contacts the reverse sheet feed roller to form a second feed nip, and configured to rotate in accordance with the rotation of the reverse sheet feed roller, wherein the sheet guided to the first feed path by the branching member reaches the first feed nip, and passes through the first feed nip in accordance with the rotation of the reverse sheet feed roller, and wherein the sheet guided to the second feed path by the branching member reaches the second feed nip, and the rotation direction of the reverse sheet feed roller is reversed before the rear end of the sheet passes through the second feed nip, to thereby feed the sheet in the second feeding direction opposite to the first feeding direction.

10. The sheet feeder according to claim 8, further comprising:

at least one downstream reverse feed roller provided downstream of the reverse sheet feed roller in the second feeding direction, wherein an ON and OFF control is performed on the hitting member moving mechanism and the movable gear moving mechanism to synchronize the driving of the reverse feed roller with the driving of the downstream reverse feed roller.

11. The sheet feeder according to claim 10, wherein, in the ON and OFF control of the hitting member moving mechanism and the movable gear moving mechanism, an operation start signal is transmitted to each of the hitting member moving mechanism and the movable gear moving mechanism faster than one of start and stop of the operation of the downstream reverse feed roller by a predetermined time taken for the each of the hitting member moving mechanism and the movable gear moving mechanism to receive the operation start signal and complete the operation thereof.

* * * * *